US005154237A

United States Patent [19]

Cooper

[11] Patent Number: 5,154,237

[45] Date of Patent: Oct. 13, 1992

[54] DETONATION SUPPRESSION

[75] Inventor: Stephen P. Cooper, Weybridge, England

[73] Assignee: Kidde-Graviner Limited, Derby, England

[21] Appl. No.: 654,725

[22] Filed: Feb. 13, 1991

[51] Int. Cl.[5] ..... A62C 3/06; A62C 3/00; A62C 2/06; A62C 2/08

[52] U.S. Cl. ..... 169/54; 169/48; 169/61

[58] Field of Search ..... 169/54, 48, 56, 60, 169/61, 70

[56] References Cited

U.S. PATENT DOCUMENTS

| | | | |
|---|---|---|---|
| 347,797 | 8/1886 | Hexamer | 169/54 X |
| 1,102,228 | 7/1914 | Balfour | 169/60 |
| 1,787,927 | 1/1931 | Bullard . | |
| 3,268,009 | 8/1966 | Bussey et al. | 169/61 X |
| 3,909,954 | 10/1975 | Zoukourian | 169/61 X |
| 4,194,570 | 3/1980 | Arencibia. Jr. | 169/54 X |
| 4,964,470 | 10/1990 | Gaulin | 169/54 X |
| 4,997,046 | 3/1991 | Evans. III | 169/54 |
| 5,018,585 | 5/1991 | Brennecke et al. | 169/54 X |

FOREIGN PATENT DOCUMENTS

| | | | |
|---|---|---|---|
| 3831828 | 3/1990 | Fed. Rep. of Germany | 169/54 |
| 257201 | 6/1988 | German Democratic Rep. | 169/54 |
| 427720 | 4/1975 | U.S.S.R. | 169/54 |
| 1416131 | 8/1988 | U.S.S.R. | 169/54 |
| 1431774 | 10/1988 | U.S.S.R. | 169/54 |
| 1516126 | 10/1989 | U.S.S.R. | 169/54 |

*Primary Examiner*—Margaret A. Focarino
*Assistant Examiner*—James M. Kannofsky
*Attorney, Agent, or Firm*—Leydig, Voit & Mayer

[57] ABSTRACT

Suppression apparatus for suppressing detonations in a pipeline which may contain an explosible vapour comprising suppressant discharge units for discharging a suppressant substance into the pipeline within a predetermined operating time. Detectors are positioned upstream of the suppressor means by sufficient distance in relation to the expected speed of travel of the detonation front along the pipeline, and in relation to the predetermined operating time of the suppressant discharge units, that the pipeline in the region of the discharge units will be supplied with an amount of suppressant which is sufficient to ensure that the detonation is suppressed when it reaches the discharge units. The suppressant may be a powder or water. Mechanical arresting means may also be provided such as a valve for positively blocking the pipeline in the event of the detection of a detonation, and/or the pipeline may have a membrane which is ruptured by the detonation so as to vent it to atmosphere.

19 Claims, 2 Drawing Sheets

DETONATION SUPPRESSION

The invention relates to detonation suppression. Embodiments of the invention to be described in more detail below are for use in suppressing detonations in pipelines which may contain explosible vapours.

According to the invention, there is provided suppression apparatus for suppressing detonations in a pipeline which may contain an explosible vapour, comprising suppression means operative when activated to discharge a suppressant into the pipeline within a predetermined operating time, and detonation detector means for detecting the existence of a detonation at a position upstream of the suppression means and connected to activate the suppression means.

According to the invention, there is further provided a method of suppressing detonations in a pipeline which may contain an explosible vapour, comprising the steps of detecting the existence of a detonation at a predetermined detection position in the pipeline, and responding to such detection by discharging a suppressant into the pipeline at a suppression position downstream of the detection position and within a predetermined operating time.

In this specification and its claims, the terms "upstream" and "downstream" are with reference to the direction of travel of the detonation or deflagration along the pipeline to the suppression means or suppression position (which direction may be opposite to the direction of travel of the fluid along the pipeline).

Apparatus embodying the invention for suppressing detonations in vapour-containing pipelines, and methods according to the invention of suppressing such detonations, will now be described, by way of example only, with reference to the accompanying diagrammatic drawings in which.

The pipeline to be considered in more detail below may be a pipeline for connecting a ship to a shore facility and, in particular, for connecting an oil tanker to such a shore facility. Such a pipeline may be long, of the order of 5 kilometers for example. By means of such a pipeline, oil or other combustible hydrocarbon-based fluid is pumped between the oil tanker and the shore facility. When pumping is finished, the pipe will be full of hydrocarbon vapour. For various reasons, in particular environmental reasons, the vapour cannot be vented to atmosphere but must be recovered. This is done by pumping air through the pipeline to force the vapour out of the pipeline into a suitable form of storage from where it can be recovered. However, such an operation inevitably creates a hydrocarbon/air mixture in which the hydrocarbon concentration will vary but is likely to produce explosible conditions. In the event of a spark or other ignition source, there is therefore a very high risk of a deflagration occurring which, during its travel along the pipeline will develop into a detonation front travelling at high speed along the pipeline, obviously creating danger and the risk of severe damage.

Figure 1:
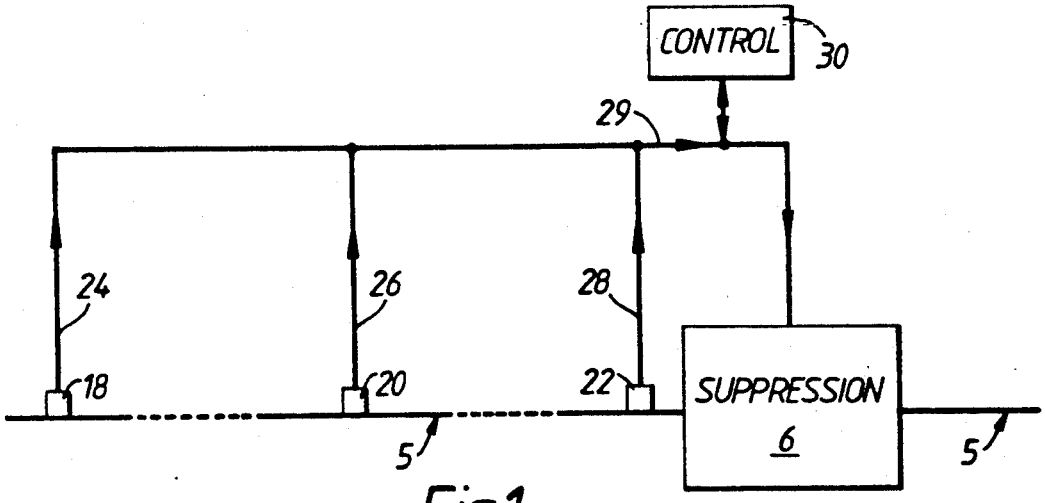
FIG. 1 is a schematic diagram of one of the pipelines in association with the apparatus.

Referring to FIG. 1, the pipeline is shown diagrammatically at 5, and the suppression apparatus at 6. The apparatus 6 will be described in detail below with reference to FIGS. 2, 3, 4 and 5.

Detectors 18,20 and 22 are positioned along the pipeline for detecting detonations and deflagrations in the manner to be described in more detail below. Their output signals are fed by connections 24,26,28 and 29 to a central control unit 30. This is connected to control the suppression apparatus 6.

The detectors 18,20 and 22 are preferably pressure sensors but may be of any suitable type (for example, optically sensitive).

The detectors 18,20 and 22 are positioned along the pipeline at predetermined distances from the apparatus 6, these predetermined distances being selected in accordance with the manner in which a detonation is likely to occur in the pipeline and progress along the pipeline.

When ignition occurs within the pipeline, deflagration will take place initially. In other words the air/vapour mixture within the pipeline will burn, the wave front initially travelling relatively slowly, at a speed of the order of 10 m/sec. The mechanism is purely chemical at this stage. As the wave front travels outwards from the initial ignition point, however, it will become affected by the confining effect of the pipeline which will cause a build-up in pressure and a resultant pressure wave. At first, the flame front, i.e. the position of the heat-releasing chemical reaction wave, moves more slowly than the pressure wave which moves out at the speed of sound. Subsequently, the build-up of pressure caused by the confinement accelerates the flame front relative to the pressure wave until it catches up with the pressure wave, at which point the two become closely coupled in a detonation wave. Normally, a distance of 2 to 6 m from ignition is required for this transition to a detonation, dependent on the nature of the fuel, its concentration, initial pressure and temperature and the like. The resultant detonation wavefront initially accelerates to an "over-driven" state in which it travels at very high speed, of the order of 4.5 km/sec. After travelling a distance of the order of 50 meters along the pipeline, however, the detonation wave becomes more stable, reducing to a still-high speed of the order of 1.5 to 2 km/sec.

As stated above, the detectors 18,20 and 22 are positioned to take account of these different speeds of travel, assuming that the suppression apparatus 6 requires a time somewhat less than 50 milliseconds to operate (that is, to be ready to suppress the arriving event).

Thus, upstream (that is to the left in FIG. 1) of detector 18 there is a considerable length of pipeline. If ignition has occurred in this length of pipeline, the chances are therefore high that it will have passed through the deflagration state and the over-driven detonation state and have reached the stable detonation state, travelling at a speed of the order of 1.5 to 2 km/sec. Detector 18 is therefore positioned approximately 100 meters upstream of the suppression apparatus 6. The detonation wave will thus take 50 milliseconds to travel from the detector 18 to the apparatus 6. This 50 millisecond period is sufficient to allow the suppression apparatus 6 to operate and be ready, therefore, to suppress the detonation when it reaches the apparatus 6.

Detector 22 is provided for the purpose of detecting deflagration adjacent to the apparatus 6. It is thus positioned 2 to 3 meters upstream of the apparatus 6. As the deflagration wave travels at a low speed, initially of the order of 10 meters per second, this allows more than sufficient time to operate the suppression apparatus 6.

Detector 20 is positioned approximately mid-way between detectors 18 and 22, and is thus about 50 meters from the suppression apparatus 6. Detector 20 is provided for the purpose of detecting ignition within the length of pipeline between detectors 18 and 22. In the absence of detector 20, ignition occurring at, say, 45 meters from the apparatus 6 could produce an over-driven detonation wave which would not be detected until it reached detector 22, allowing insufficient time (at the speed of travel of the detonation wave) for the suppression apparatus 6 to carry out effective suppression action. Such a detonation would, however, be detected by detector 20. Although the resultant detonation wave would be travelling at the over-driven speed (of the order of 4.5 km/sec) by the time it reached the apparatus 6, its average speed over the distance from the ignition source to the apparatus 6 would be less than this, and probably less than 2 km/sec. Its detection by detector 20 would thus cause operation of the suppression apparatus 6 in sufficient time.

It will be understood that the wavefront resulting from ignition will travel in both directions along the pipeline. Therefore, for example, ignition occurring at a position between detectors 18 and 20 may be detected by detector 18 before it is detected by detector 20.

The figures given above are purely by way of example. If the pipeline is of extra large diameter, for example, having the effect that suppression may take longer, it may be advisable for detector 18 to be moved further upstream and for detector 20 to be supplemented by one or more further detectors positioned between detectors 18 and 22.

Various forms of the suppression apparatus 6 will now be described.

Figure 2:
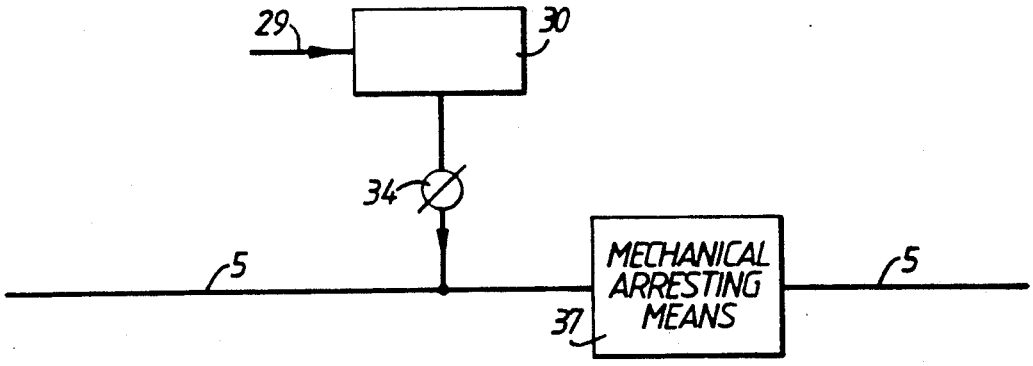
FIG. 2 is a schematic diagram of one form of the apparatus.

One such form is shown in FIG. 2 and comprises unit 34. Each of these units discharges a suppressant substance into the pipeline when activated, and the unit is connected to be activated by the control unit 30 (FIG. 1). The suppressant unit 34 may be of any suitable type, discharging suppressant powder (for suppressing detonations or deflagrations) such as ammonium dihydrogen phosphate or sodium bicarbonate for example, or discharging water as a fine spray, or discharging other fire suppressant such as a Halon.

In addition, the suppression apparatus includes mechanical arresting means 37. When activated (whether by the control unit 30 or by other means), this mechanically prevents further travel of the detonation wave along the pipeline. Examples of mechanical arresting means 37 will be described below. The means 37 is connected to be activated by control unit 30 if appropriate.

When a detonation or deflagration is detected by the detectors 18,20 and 22 (or one of them) in the manner explained, the unit 34 is activated to discharge suppressant into the pipeline and suppression action takes place when the front arrives so as to suppress the detonation or deflagration. The suppressing action of the unit 34 is found t be capable of satisfactorily suppressing an arriving detonation front. This effectiveness of the suppression action carried out by the suppressant unit 34 is surprising. Detonation suppressants (whether powder or water) require a measurable time (tens of milliseconds) in order to carry out effective suppression, and at first sight the speed of travel of the detonation front along the pipeline would appear to be such that there is insufficient time for suppression to take place properly. However, it has been found that adequate suppression does take place. It is believed that two effects are responsible for this surprising result: firstly, provided that the suppressant unit is operated (that is, that it discharges its suppressant) sufficiently in advance of arrival of the detonation front, a significant length of the pipeline (e.g. 5 meters) will be filled with suppressant, thus increasing the effective time for which the suppressant can act on the detonation; and, secondly, the detonation front will carry some of the suppressant with it as it continues to travel along the pipeline, so that the suppression action continues while the detonation moves down the pipeline and the effective time period for which the suppressant can act is increased.

When the control unit 30 activates the suppression units 34,36 it may also activate the mechanical arresting means 37 which therefore acts to prevent further travel of the detonation front along the pipeline if the circumstances are such that it has not been completely suppressed by units 34,36. Alteratively, the mechanical arresting means 37 may be activated in other ways, though it still acts to prevent further travel of the detonation front along the pipeline.

Figure 3:
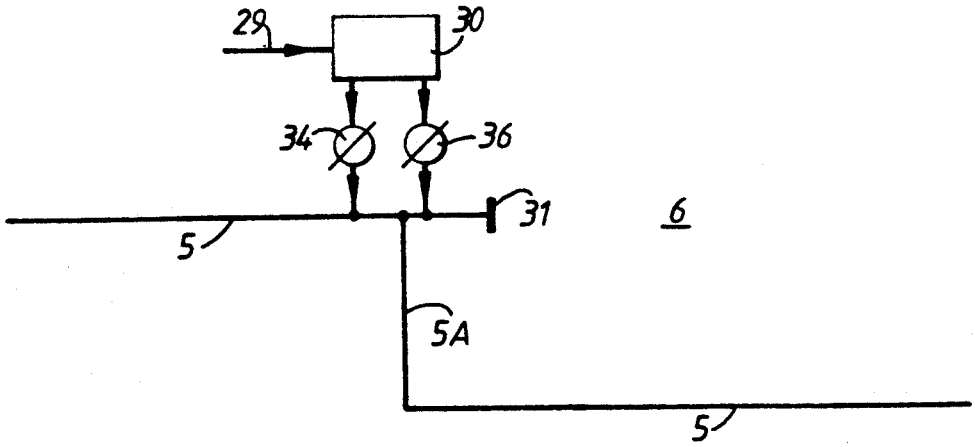
FIG. 3 is a schematic diagram of another form of the apparatus.

FIG. 3 illustrates one form which the mechanical arresting means 37 can take, being in the form of a vent. Here, the apparatus 6 incorporates an abrupt change in direction for the pipeline 5, the upstream and downstream portions of the pipeline 5 being connected by an intermediate pipeline portion 5A. The upstream portion of the pipeline is terminated by a vent 31 which is closed off by a rupturable membrane. In addition, there is a second suppression unit 36 similar to unit 34 and also operated by the control unit 30. Therefore, the travelling wavefront of the detonation (if it has not been suppressed by the suppression units 34,36) ruptures the membrane at the vent 31 and the resultant pressure release provides further suppression of the detonation if it has not been completely suppressed by the suppression units 34,36. Here, therefore, the mechanical arresting means is not activated by the control unit 30 but by the actual detonation wavefront.

In practice, it is desirable to construct the apparatus 6 so that it is capable of suppressing a detonation or deflagration occurring on either side of the apparatus 6 along the pipeline. Detectors corresponding to detectors 18,20 and 22 would therefore be provided on each side of the apparatus 6.

Figure 4:
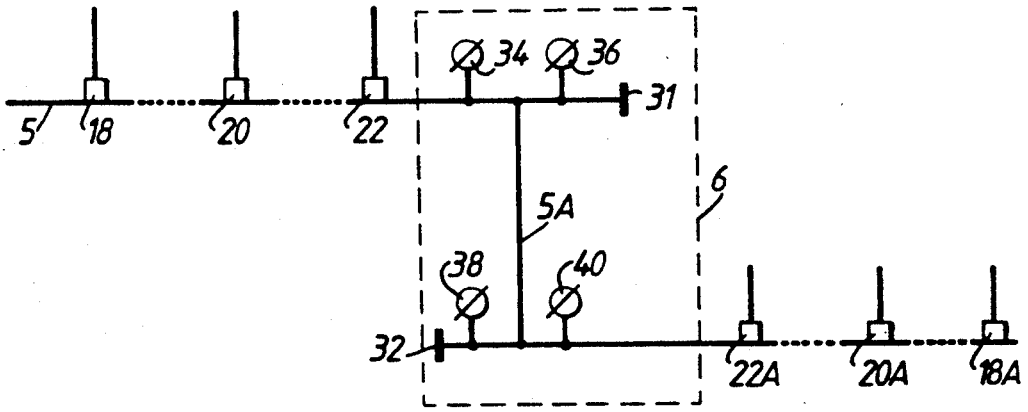
FIG. 4 is a schematic diagram of a modified form of the apparatus of FIG. 3.

FIG. 4 shows a modified form of the apparatus 6 of FIG. 2 constructed to render it symmetrical in this way, detectors 18A,20A and 22A corresponding to detectors 18,20 and 22 and controlling suppression units 38 and 40 (corresponding to units 34 and 36) via control unit 30 (not shown). A vent 32 corresponding to vent 31 is also provided. For extra safety, all the units 34,36,38 and 40 can be activated by either set of detectors.

Figure 5:
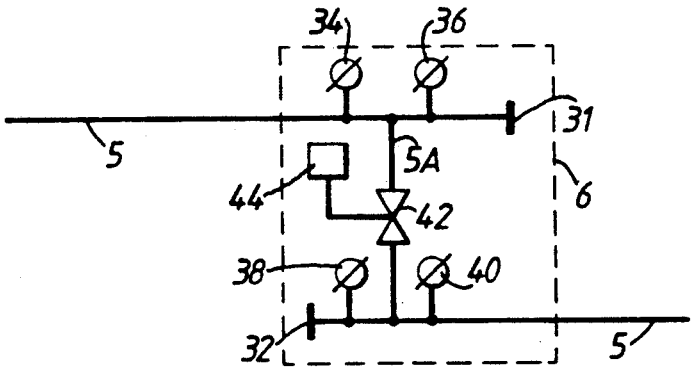
FIG. 5 is a schematic diagram of another form of the apparatus.

FIG. 5 shows a modified form of the apparatus of FIG. 4, in which the mechanical arresting means 37 also includes a valve 42 of the "guillotine" type which is positioned in the intermediate length of pipeline 5A. The valve has a valve blade which, when the valve is operated or closed, moves into a position in which it completely closes off the pipeline. Valve 42 is operated by a drive unit 44. Motive power for closing the valve may be derived from a cylinder (not shown) containing an inert gas such as nitrogen under pressure. The drive unit 44 is controlled by control unit 30 (FIG. 1). Valve 42 thus augments the suppression action by completely closing the pipeline so as to arrest the detonation front and prevent ignition of the explosible air/vapour mixture on the downstream side of the valve blade. In this case, therefore, the mechanical arresting means is activated by the control unit 30.

Figure 6:
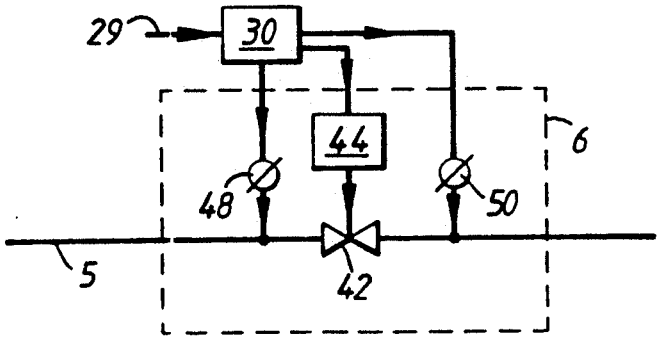
FIG. 6 is a schematic diagram of a further form of the apparatus.

A further form of the suppression apparatus 6 is shown in FIG. 6. In this form, the pipeline 5 is continuous, that is, there is no intermediate pipeline section 5A and no resultant abrupt changes in direction, and nor are the vents 31,32 provided. Instead, the mechanical arresting means 37 consists only of a valve 42 corresponding to that shown in FIG. 4. Suppression units 48 and 50 (corresponding to units 34 to 40 in FIGS. 2 and 3) are positioned on opposite sides of the valve. Suppression therefore takes place as a result of the combination of the actions of the valve 42 and the suppression units 48 and 50.

FIG. 6 shows the control unit 30 and its connections to the suppression units 48 and 50 and to the valve 42.

Valve 42 (whether in the configuration shown in FIG. 5 or that shown in FIG. 6) is normally ineffective to suppress detonations on its own. The travelling detonation front may be travelling at such speed and with such momentum that actual damage to the valve blade takes place. This may result in some of the detonating vapour travelling past the damaged valve blade and igniting the explosible air/vapour mixture on the downstream side. Even if this does not occur, however, the damage to the valve blade will necessitate dismantling and repair. Furthermore, and particularly for large diameter pipelines, the mass and momentum of the detonation front will be such that, when arrested by the closed valve blade, it will maintain high pressure on the valve blade for a significant length of time. The mass of arrested detonating air/vapour mixture will heat the valve blade to a temperature which may alone be sufficient to cause ignition of the mixture on the opposite side of the valve blade. The suppression action of the suppression units 48 and 50 (and also of the suppression units 34,36 shown in the FIG. 5 arrangement) is therefore important, not only in suppressing the actual detonation but also in protecting the valve blade. Thus, when a detonation occurs, the suppression units on both sides of the valve are operated; the suppression units on the downstream side of the valve suppress any detonation which may break through past the valve.

What is claimed is:

1. Suppression apparatus for suppressing detonations in a pipeline which may contain an explosible vapour, comprising suppression means operative when activated to discharge a suppressant into the pipeline within a predetermined operating time, and detonation detector means spaced along the pipeline from the suppression means and for detecting the existence of a detonation and connected to activate the suppression means, the detector means being so distanced from the suppression means in relation to the expected speed of travel of the detonation front and the length of the predetermined operating time that the pipeline in the region of the suppression means will be supplied with a sufficient amount of the suppressant to suppress the detonation when it reaches the suppression means, the detector means including first and second detectors physically separated from each other along the pipeline, the first detector being positioned sufficiently far from the suppression means that the time of travel therefrom to the suppression means of a stable detonation wave is greater than the said predetermined operating time, and the second detector being positioned sufficiently far from the suppression means that the time of travel therefrom to the suppression means of a deflagration wave is greater than the said predetermined operating time.

2. Apparatus according to claim 1, in which the suppressant is a powder.

3. Apparatus according to claim 1, in which the suppressant is water-based.

4. Apparatus according to claim 1, including a third detector positioned between the first and second detectors for detecting detonations resulting from explosions therebetween.

5. Apparatus according to claim 1, in combination with mechanical arresting means operative when activated to mechanically prevent further travel along the pipeline of an arriving detonation front.

6. Apparatus according to claim 5, in which the mechanical arresting means comprises normally closed vent means in the pipeline which is positioned to be ruptured by a detonation so as to vent it to the atmosphere.

7. Apparatus according to claim 6, in which the pipeline means includes an abrupt change of direction with the vent means being positioned thereat.

8. Apparatus according to claim 5, in which the mechanical arresting means comprises valve means in the pipeline and connected to be closed within the predetermined operating time by detection of a detection by the detector means.

9. Apparatus according to claim 8, in which the suppression means comprises suppression means positioned on both the upstream and the downstream sides of the valve means.

10. Apparatus according to claim 8, in which the mechanical arresting means also includes normally closed vent means in the pipeline which is positioned to be ruptured by a detonation so as to vent it to the atmosphere.

11. A method of suppressing detonations in a pipeline which may contain an explosible vapour, comprising the steps of detecting, at least two predetermined detection positions in the pipeline, the existence of a detonation, and responding to such detection by discharging a suppressant into the pipeline at a suppression position in the pipeline spaced from the detection positions and within a predetermined operating time, the distances from the positions at which the detection steps take place to the position at which the suppressant discharge step takes place being such in relation to the expected speed of travel of the detonation front and the predetermined operating time that the pipeline at the suppression position is supplied with a sufficient amount of the suppressant to suppress the detonation when it reaches that position, one of the detection positions being sufficiently far from the suppression position that the time of travel therebetween of a stable detonation wave detected at that detection position is greater than the predetermined operating time, and the other detection position being sufficiently far from the suppression position that the time of travel therebetween of a deflagration wave detected at that detection position is greater than the predetermined operating time.

12. A method according to claim 11, in which the discharge step comprises the step of discharging a suppressant powder.

13. A method according to claim 11, in which the discharge step comprises the step of discharging a water-based suppressant.

14. A method according to claim 11, including the step of responding within the predetermined operating time to the said detection by mechanically preventing further travel of the detonation along the pipeline.

15. A method according to claim 14, in which the mechanical prevention step comprises the step of blocking further travel of the detonation along the pipeline.

16. A method according to claim 14, in which the mechanical prevention step comprises the step of physically venting the pipeline to atmosphere.

17. A method according to claim 16, in which the pipeline is vented to atmosphere by rupture caused at a predetermined weakened point thereby by the detonation.

18. Suppression apparatus for suppressing detonations in a pipeline which may contain an explosible vapour, comprising suppression means operative when activated to discharge a suppressant into the pipeline within a predetermined operating time, and detonation detector means for detecting the existence of a detonation at a position in the pipeline spaced therealong from the suppression means and connected to activate the suppression means, the detector means being positioned at such distance from the suppression means in relation to the expected speed of travel of the detonation front and the length of the predetermined operating time that the pipeline in the region of the suppression means will be supplied with a sufficient amount of the suppressant to suppress the detonation when it reaches the suppression means, the detector means including a first detector positioned sufficiently far from the suppression means that the time of travel therefrom to the suppression means of a stable detonation wave is greater than the said predetermined operating time, a second detector positioned sufficiently far from the suppression means that the time of travel therefrom to the suppression means of a deflagration wave is greater than the said predetermined operating time, and a third detector positioned between the first and second detectors for detecting detonations resulting from explosions therebetween.

19. Suppression apparatus for suppressing detonations in a pipeline which may contain an explosible vapour, comprising suppression means operative when activated to discharge a suppressant into the pipeline within a predetermined operating time, and detonation detector means for detecting the existence of a detonation at a position in the pipeline spaced therealong from the suppression means and connected to activate the suppression means, the detector means being positioned at such distance from the suppression means in relation to the expected speed of travel of the detonation front and the length of the predetermined operating time that the pipeline in the region of the suppression means will be supplied with a sufficient amount of the suppressant to suppress the detonation when it reaches the suppression means, the detector means including a first detector positioned sufficiently far from the suppression means that the time of travel therefrom to the suppression means of a stable detonation wave is greater than the said predetermined operating time, and a second detector positioned sufficiently far from the suppression means that the time of travel therefrom to the suppression means of a deflagration wave is greater than the said predetermined operating time, and mechanical arresting means operative when activated to mechanically prevent further travel along the pipeline of an arriving detonation front, the mechanical arresting means comprising valve means in the pipeline and connected to be closed within the predetermined operating time by detection of a detonation by the detector means, the suppression means comprising suppression means positioned on both sides of the valve means.

* * * * *